US006632160B2

(12) United States Patent
LaFond et al.

(10) Patent No.: US 6,632,160 B2
(45) Date of Patent: Oct. 14, 2003

(54) BACK ROLLER EXERCISE APPARATUS

(75) Inventors: Julie LaFond, Newport Beach, CA (US); Jay Blahnik, Laguna Beach, CA (US); Chris Lokan, Sierra Madre, CA (US)

(73) Assignee: Thruster Partners, LLC, Newport Beach, CA (US)

( * ) Notice: Subject to any disclaimer, the term of this patent is extended or adjusted under 35 U.S.C. 154(b) by 366 days.

(21) Appl. No.: 09/727,381

(22) Filed: Nov. 30, 2000

(65) Prior Publication Data

US 2002/0065176 A1 May 30, 2002

(51) Int. Cl.[7] ..... A63B 21/068

(52) U.S. Cl. ..... 482/95; 482/132; 482/135; 482/904

(58) Field of Search ..... 482/92–96, 51, 482/101, 132, 135, 139, 141, 142, 904, 907; 297/14, 338, 343, 344.12; 601/24; 606/243

(56) References Cited

U.S. PATENT DOCUMENTS

| | | | | |
|---|---|---|---|---|
| 1,996,350 A | | 4/1935 | Schaff | |
| 2,783,045 A | | 2/1957 | Bosch | |
| 3,622,154 A | | 11/1971 | Williams | |
| 4,176,836 A | | 12/1979 | Coyle | |
| 4,197,839 A | | 4/1980 | Lay | |
| 4,286,782 A | * | 9/1981 | Fuhrhop | 482/99 |
| 4,324,399 A | | 4/1982 | Rickey | |
| 4,620,701 A | | 11/1986 | Mojden | |
| 4,638,995 A | | 1/1987 | Wilson | |
| 4,695,050 A | | 9/1987 | Smith | |
| 4,700,946 A | * | 10/1987 | Breunig | 482/57 |

(List continued on next page.)

FOREIGN PATENT DOCUMENTS

| | | | | |
|---|---|---|---|---|
| DE | 198 01 672 A1 | * | 11/1998 | 482/103 |
| FR | 2462157 | * | 2/1981 | 482/101 |
| SU | 1780776 A1 | * | 12/1992 | 482/99 |
| SU | 1818112 A1 | * | 5/1993 | 482/94 |

OTHER PUBLICATIONS

Total Gym Comparisons From Bodytrends.com Web Site, 7 pages.

Total Gym Accessories From Bodytrends.com Web Site, 9 pages.

Total Gym From Bodytends.com Web Site, 3 pages.

Selected Pages From Nordicflex Brochure, 3 pages.

Selected Pages From Nordictrack Winter 1998 Catalog, 5 pages.

The Linex VKR Power Tower X2.25 From Bodytrends.com Web Site, 2 pages.

*Primary Examiner*—Nicholas D. Lucchesi
*Assistant Examiner*—Victor Hwang
(74) *Attorney, Agent, or Firm*—Jeffer, Mangels, Butler & Marmaro LLP

(57) ABSTRACT

A back roller exercise apparatus is disclosed having a base, a support member and a backrest slidably engaged with the support member. In a preferred embodiment, the exercise apparatus includes a seat adjustably attached to the support member, a lower bar attached to the seat, and an upper bar adjustably attached to the support member. In an operating configuration, the support member is substantially vertical and the backrest slides up and down between the seat and the upper end of the support member. The support member is preferably pivotally attached to the base. In a storage configuration, the support member is pivoted such that it is substantially parallel to the base. The exercise apparatus is utilized to perform squats, lunges, narrow pull-ups, wide pull-ups, dips and push-ups. The exercise apparatus may be utilized in three exercise modes: strength, aerobic and circuit training.

30 Claims, 8 Drawing Sheets

U.S. PATENT DOCUMENTS 5,044,633 A 9/1991 Rice
5,162,030 A * 11/1992 Tanski ..... 482/91
5,169,363 A 12/1992 Campanaro
5,201,694 A 4/1993 Zappel
5,263,913 A 11/1993 Boren
5,352,171 A * 10/1994 Lin ..... 482/96
5,407,404 A 4/1995 Killian
5,419,752 A * 5/1995 James et al. ..... 601/5
5,433,685 A 7/1995 Winslow
5,445,583 A * 8/1995 Habing ..... 482/52
5,549,529 A 8/1996 Rasmussen
5,669,864 A * 9/1997 Brister ..... 482/132
5,669,865 A 9/1997 Gordon
5,733,229 A * 3/1998 Dalebout et al. ..... 482/96
5,810,698 A * 9/1998 Hullett et al. ..... 482/96
5,829,826 A * 11/1998 Ziccardi ..... 297/118
5,833,590 A 11/1998 Chiu
5,885,197 A 3/1999 Barton
5,941,803 A * 8/1999 Chamberlain et al. ..... 482/96
5,964,684 A 10/1999 Sokol
5,971,901 A 10/1999 Shaw
6,015,369 A 1/2000 Rasmussen
6,231,486 B1 * 5/2001 Lee ..... 482/101
6,244,995 B1 * 6/2001 Prsala ..... 482/96
6,474,732 B1 * 11/2002 Merensky ..... 297/14

* cited by examiner

BACK ROLLER EXERCISE APPARATUS

FIELD OF THE INVENTION

The present invention relates generally to an exercise apparatus and, more particularly, to an exercise apparatus that allows the user to perform a myriad of exercises in circuit fashion on a single apparatus without stopping to reconfigure the apparatus between exercises.

BACKGROUND OF THE INVENTION

A health and fitness club typically has a host of exercise equipment, each designed for a specific task, such as strengthening certain muscles or providing an aerobic workout. Strength training can be described as exercise for the purpose of increasing the strength of specific muscle groups, usually one muscle group at a time. Strength training is typically categorized by exercising a specific muscle group with relatively high resistance, relatively short duration and relatively low aerobic demands. Aerobic training can be described as exercise for the purpose of increasing one's aerobic capacity. Aerobic training is typically categorized by exercising multiple muscle groups simultaneously with relatively low resistance, for relatively long duration and relatively high aerobic demands. For a comprehensive workout, including aerobic and strength training exercises, the user often has to utilize multiple machines, each directed particularly to either strength training or aerobic exercise. At each machine, the user is required to make adjustments to the machine to ensure that the setting of the machine corresponds to the user's size and performance ability.

Additionally, strength training equipment is usually limited to strengthening a particular muscle or muscle group. Therefore, to strengthen a plurality of muscles, the user will be required to utilize many machines. Some strengthening equipment has been developed to exercise more than one muscle group; however, the user is required to adjust cables and weight stacks to transform the machine from performing one exercise to another exercise.

Aerobic equipment, as compared to strength training apparatus, is typically designed to facilitate a substantially longer continuous workout, to increase the heart rate and burn calories. In the typical strength training workout, it is difficult to incorporate aerobic exercise because the workout is interrupted and not continuous. The necessity of moving from one strength machine to another and adjusting each machine interferes with the aerobic exercise of the user.

It is desirable to perform exercises in a circuit fashion. Circuit training can be described as exercise for the purpose of simultaneously increasing one's strength and aerobic capacity. Circuit training is typically categorized by exercising several different muscle groups, in a strength training fashion, one after another, with little or no time lapse between each muscle group. Accordingly, there is a need for a machine that allows the user to perform a myriad of exercises in circuit fashion on a single apparatus without stopping to reconfigure the apparatus between exercises.

Providing a single apparatus that allows a user to perform a comprehensive workout is especially convenient for the home. Few people have the space to accommodate the various pieces of equipment that are provided in the gym for obtaining a comprehensive workout. However, it would be desirable and convenient to own a single apparatus that would provide a comprehensive workout tool for the home. Some disadvantages of traditional home exercise equipment, however, are bulkiness, unsightliness and excessive noise.

Specifically, known comprehensive exercise equipment occupies a large space in the home, usually clashes with the home's decor, and makes excessive noise during operation. The size of the exercise equipment makes it difficult to move the equipment and stow it away when the equipment is not in use.

It would, therefore, be desirable to provide an exercise apparatus that is relatively compact, aesthetically appealing, quiet, and is able to be moved easily and stowed in a closet or other small space.

Another disadvantage of using personal exercise equipment at home is that a novice exerciser can be injured by incorrectly performing the exercises. Additionally, traditional exercise equipment is designed for a particular fitness level, e.g., novice or advanced. A novice, who has not exercised regularly, will not be sufficiently fit to use equipment designed for a strong, advanced exerciser. However, if the novice purchases equipment designed for beginners and uses it regularly, the novice will soon outgrow the equipment and will need another machine directed to a more advanced level of exercising.

Accordingly it is desirable to provide exercise equipment that enables people of all shapes, sizes and fitness levels to correctly and effectively execute the exercises needed for obtaining a comprehensive cardiovascular and strength training workout, without suffering any injuries.

SUMMARY OF THE PREFERRED EMBODIMENTS

The exercise apparatus of the present invention is designed to provide a comprehensive exercise program for most of the body's major muscle groups. In a preferred embodiment of the invention, the exercise apparatus can be utilized in several exercise modes, including strength, aerobic and circuit training. The apparatus provides an effective exercise tool to users of all ages and fitness levels, and can be adjusted to suit users of various sizes.

The apparatus of the present invention, is well suited for a variety of fitness applications, including a home gym, a fitness facility, and a rehabilitation facility. In a preferred embodiment of the invention, the user is able to perform six of the most functionally useful exercises for conditioning with respect to sports, rehabilitation and general activity. If desired, in alternative embodiments of the invention, fewer distinct exercises may be included in a workout.

The exercise apparatus of the present invention includes a base, a vertical support member attached to the base, and a backrest slidably engaged with the support member. In a preferred embodiment, the exercise apparatus includes a seat adjustably attached to the support member, a lower bar attached to the seat, and an upper bar adjustably attached to the support member. The exercise apparatus is customized for use by a particular user in that the seat is adjustable to correspond to the length of the user's legs and the upper bar is adjustable to correspond to the user's reach.

The exercise apparatus of the present invention is readily employed for three distinct modes of exercise, namely, strength, aerobic and circuit training. Specifically, the exercise apparatus can be used to perform squats, lunges, narrow pull-ups, wide pull-ups, dips and push-ups in an uninterrupted, circuit fashion. To perform a squat, the user, from a seated position, presses his back against the backrest, and slides the backrest up and down on the support member. To perform a lunge, the motions of the squat are repeated, except that the user extends one leg outward and off of the ground, shifting his entire weight to the other leg. To perform pull ups, the user extends his arms to the upper bar, presses his back against the backrest, and using his arms and legs in the desired proportion, slides the backrest up and down on the support member. To perform a dip, the user grips the lower bar, presses his back against the backrest, and using his arms and legs in the desired proportion, slides the backrest up and down on the support member. To perform a push up, the user faces the exercise apparatus, grips the lower bar so that he is at an inclined angle from the floor, and lowers himself towards the lower bar. There is no weight stack, nor complex cable connections to be adjusted in between exercises. A preliminary height adjustment of the seat and the upper bar is made prior to beginning the exercises. Thereafter, no interruptions are necessary between exercises for adjustment of the equipment.

The exercise apparatus of the present invention utilizes the user's weight for resistance in performing the exercising. If the user is unable to support his entire weight in performing the exercises, the apparatus allows the user to distribute his weight between the leg muscles and arm muscles to assist with the performance of the exercise. At any point in a given exercise, the user decides the amount of weight that can be lifted by the upper body muscles and the amount of weight that will be lifted by the lower body muscles. As the novice user gains more experience and strength, he can begin to shift more weight to the muscles desired to be exercised. Eventually, the user will be able to perform the exercises with his entire weight supported by the muscle being exercised. One advantage of the exercise apparatus of the present invention is that the same equipment can be used by the novice exerciser and the experienced exerciser.

The exercise apparatus is designed to cause the user to maintain proper form during the exercises. While sliding the backrest up and down on the support member, the apparatus limits the range of motion of the backrest between the seat and the upper end of the user's range of motion. Accordingly, the seat prevents the user from descending beyond that user's chosen comfortable and safe range of motion with respect to the knees. Similarly, while performing a dip, the apparatus prevents the user from dipping too low and injuring his arms and shoulders.

The apparatus preferably has an operating configuration and a storage configuration. In the operating configuration, the support member is substantially vertical and the backrest slides up and down between the seat and the upper end of the user's range of motion. The support member is preferably pivotally attached to the base. In the storage configuration, the support member is pivoted such that it is substantially parallel to the base. The apparatus may be conveniently stored either vertically or horizontally. In the storage configuration, the exercise apparatus is significantly more compact and can be stored in a closet or other small area. To facilitate rolling the apparatus from one location to another, the base can be fitted with wheels. To move the apparatus, the user tilts the apparatus and, using the wheels, rolls the apparatus to the desired location.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
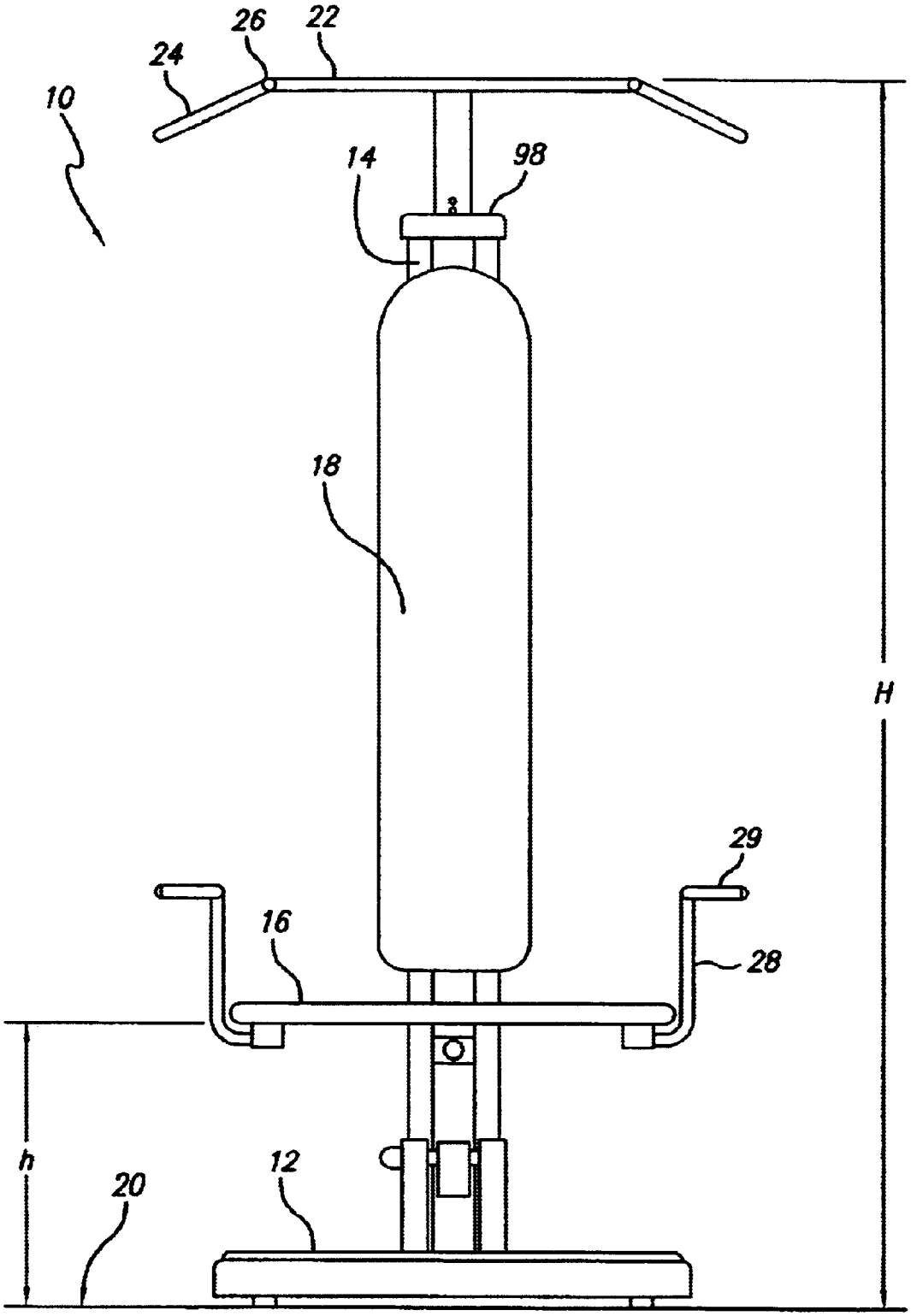
FIG. 1 is a front perspective view of a preferred embodiment of the back roller exercise apparatus of the present invention.
Figure 2A:
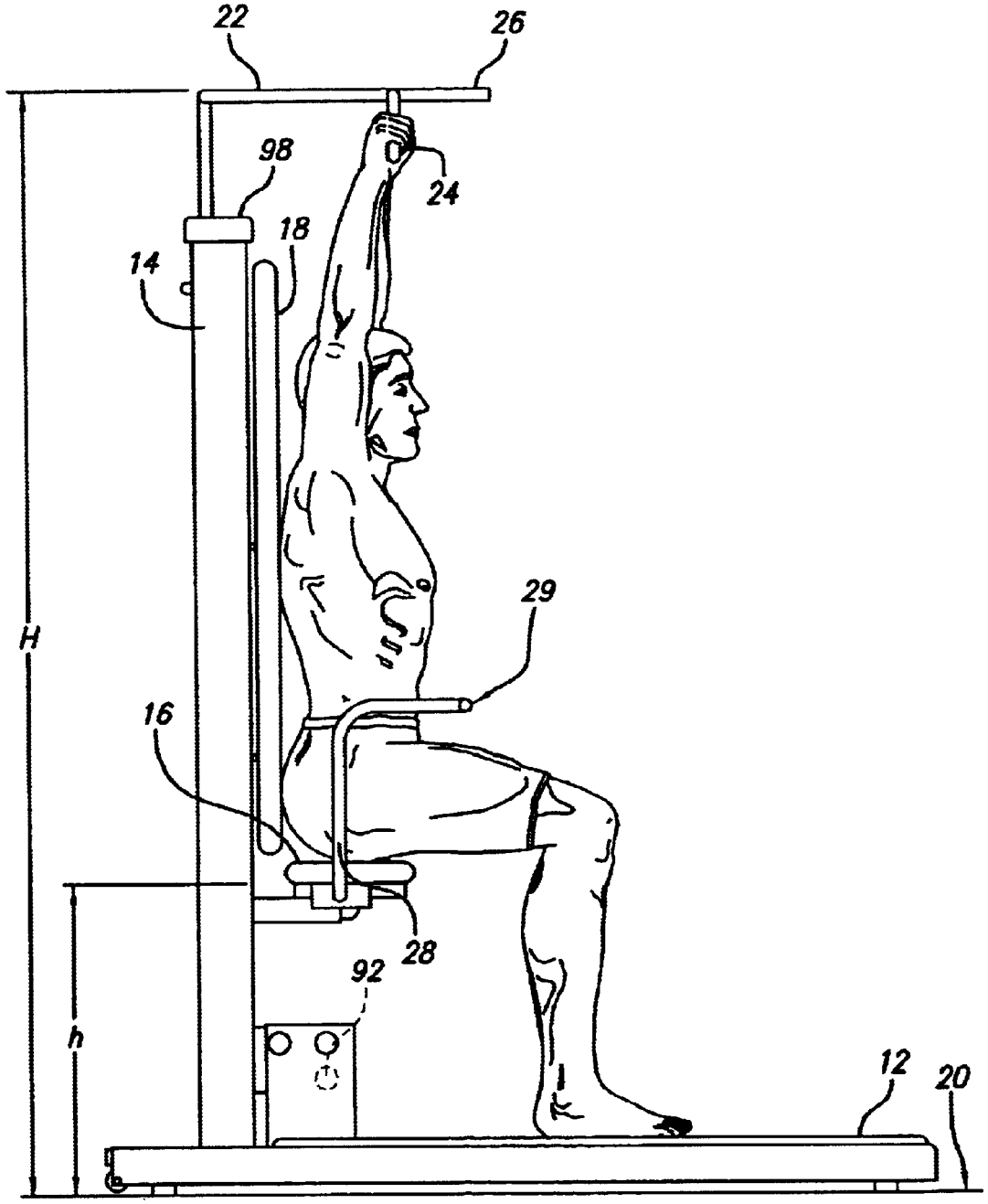
FIG. 2A is a side perspective view of a preferred embodiment of the back roller exercise apparatus of the present invention, depicting a user at the lower end of the range of motion for the squat and/or the wide pull-up exercise.

As shown in FIGS. 1 and 2A, the back roller exercise apparatus 10 preferably includes a base 12, a support member 14, an adjustable seat 16, and a movable backrest 18. In a preferred embodiment of the invention, the base 12 lies on a flat surface 20, such as the floor, in a static relationship to the flat surface 20. The support member 14 is mounted to the base 12, preferably in a perpendicular relationship to the base 12, forming a straight, upright support. The upright position of the support member 14 is advantageous in that it allows the user to exercise from a position that is functional, natural and comfortable to do so without having to lie on one's back, face down or lie on the floor. The adjustable seat 16 is movably engaged with support member 14 and adjustable to a plurality of heights off of the base 12. The movable backrest 18 is slidably engaged with the support member 14.

Figure 2B:
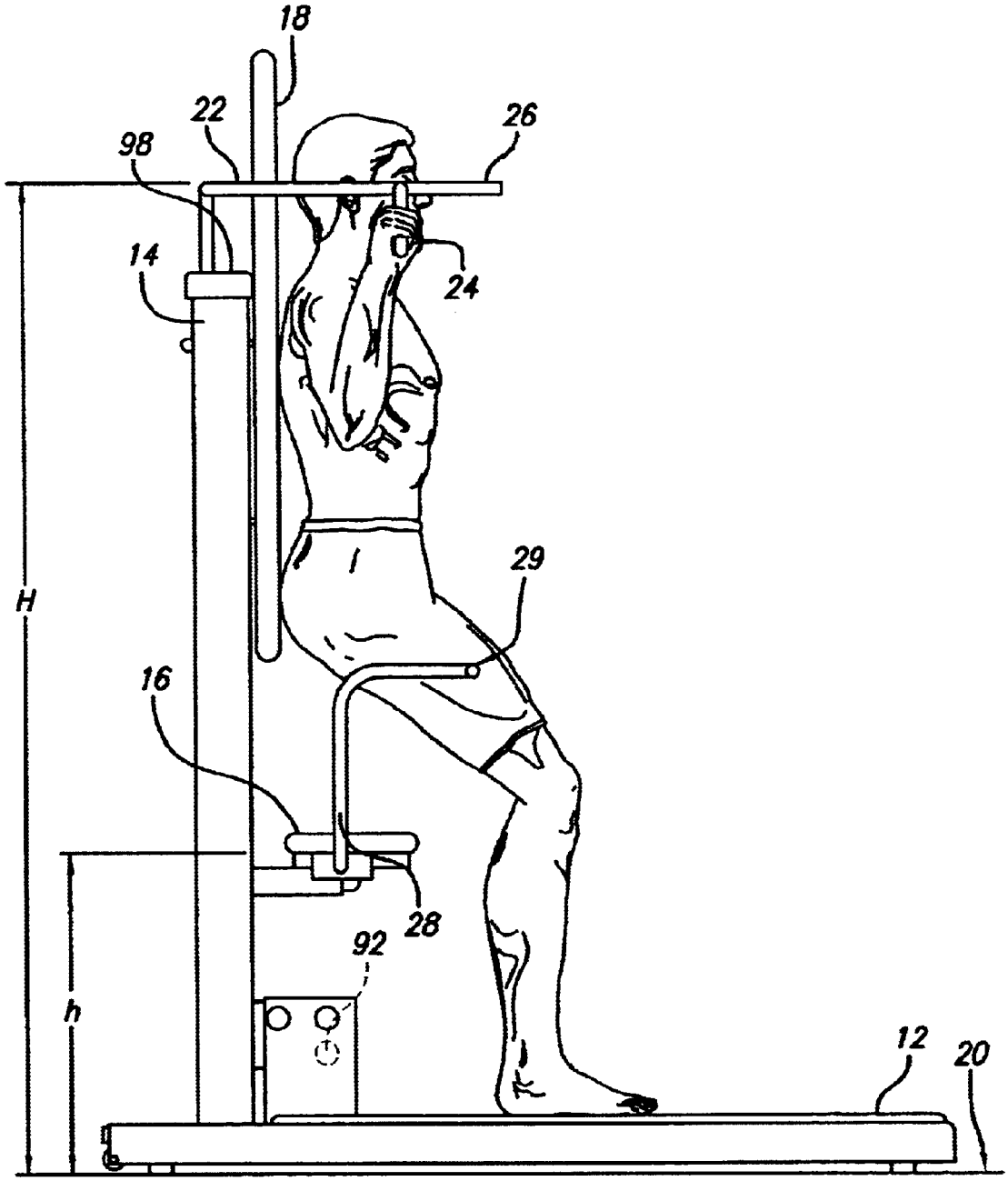
FIG. 2B is a side perspective view of a preferred embodiment of the back roller exercise apparatus of the present invention, depicting a user at the upper end of the range of motion for the squat and/or wide pull-up exercise.
Figure 2C:
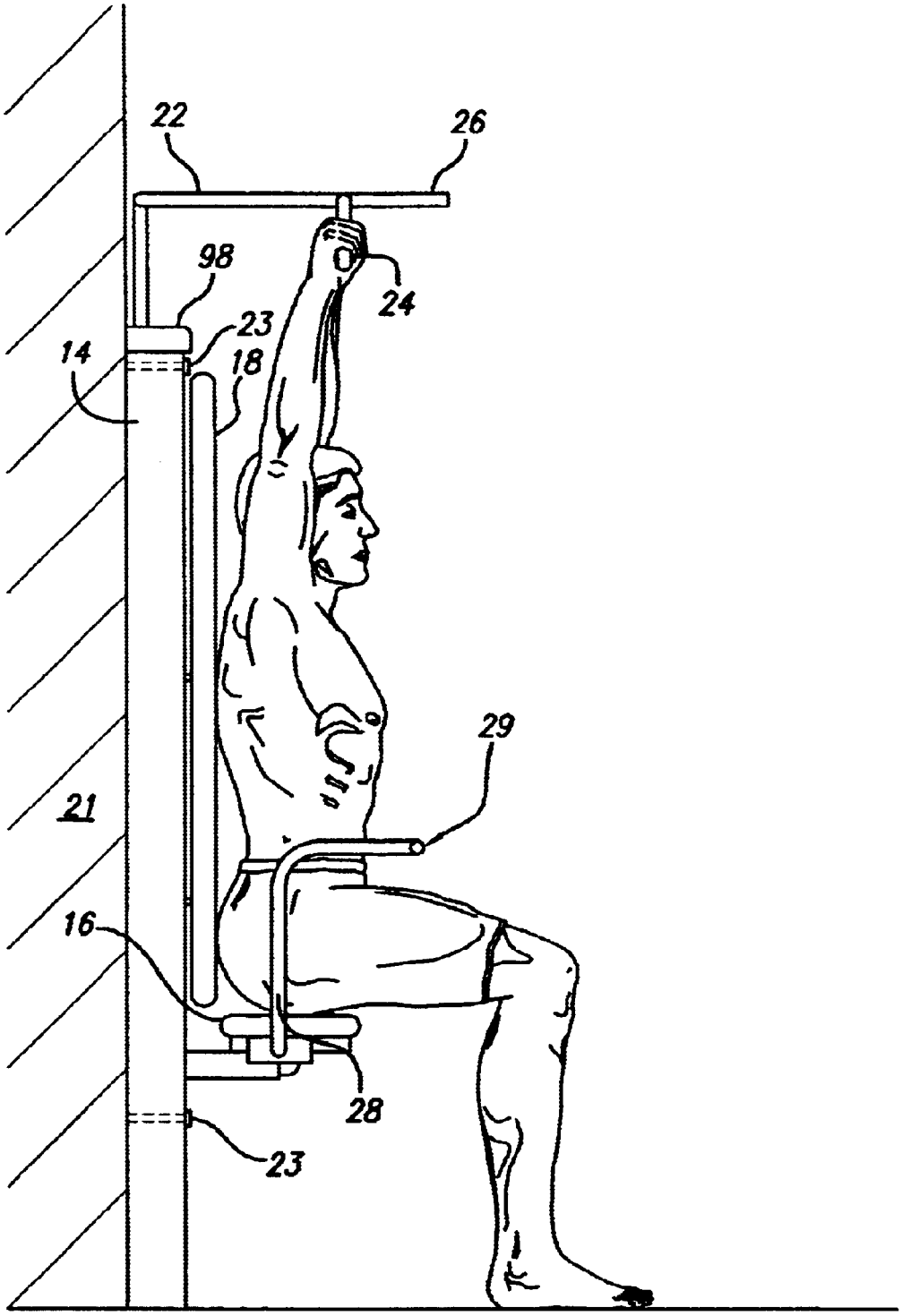
FIG. 2C is a side perspective view of an embodiment of the back roller exercise apparatus of the present invention, depicting the exercise apparatus attached to a wall.

The support member 14, as attached to the base 12, is a free-standing unit and can be placed anywhere in a room without requiring support from a wall or other vertical reinforcement. In an alternative embodiment of the present invention, the base 12 can be eliminated, and the support member 14 is placed against a wall 21 for support, as illustrated in FIG. 2C. To provide additional stability, the support member 14 is attached to the wall using a known attachment system 23, such as, for example, adhesives, screws, nails, or bolts.

In a preferred embodiment of the invention, an upper bar 22 is adjustably fastenable to the support member 14 at a plurality of vertical positions. The upper bar 22 includes side handles 24 and front handles 26. The proper height, H, of the upper bar 22 on the support member 14 depends on the height, torso, and reach of the user, the level of exercising expertise, and the range of the user's arm motion. Typically, it is desirable to adjust the upper bar 22 to a position that allows the user's hands to just reach the upper bar 22 when the user is in a seated position, as shown in FIG. 2A.

In a preferred embodiment of the exercise apparatus, a lower bar 28 is integrally attached to the seat 16. The lower bar 28 preferably includes handles 29 which are dimensioned to be comfortably gripped by the hands of the person exercising in a firm manner. The lower bar 28 must be sufficiently sturdy to support the user's weight during exercise, as discussed in more detail below.

Figure 3:
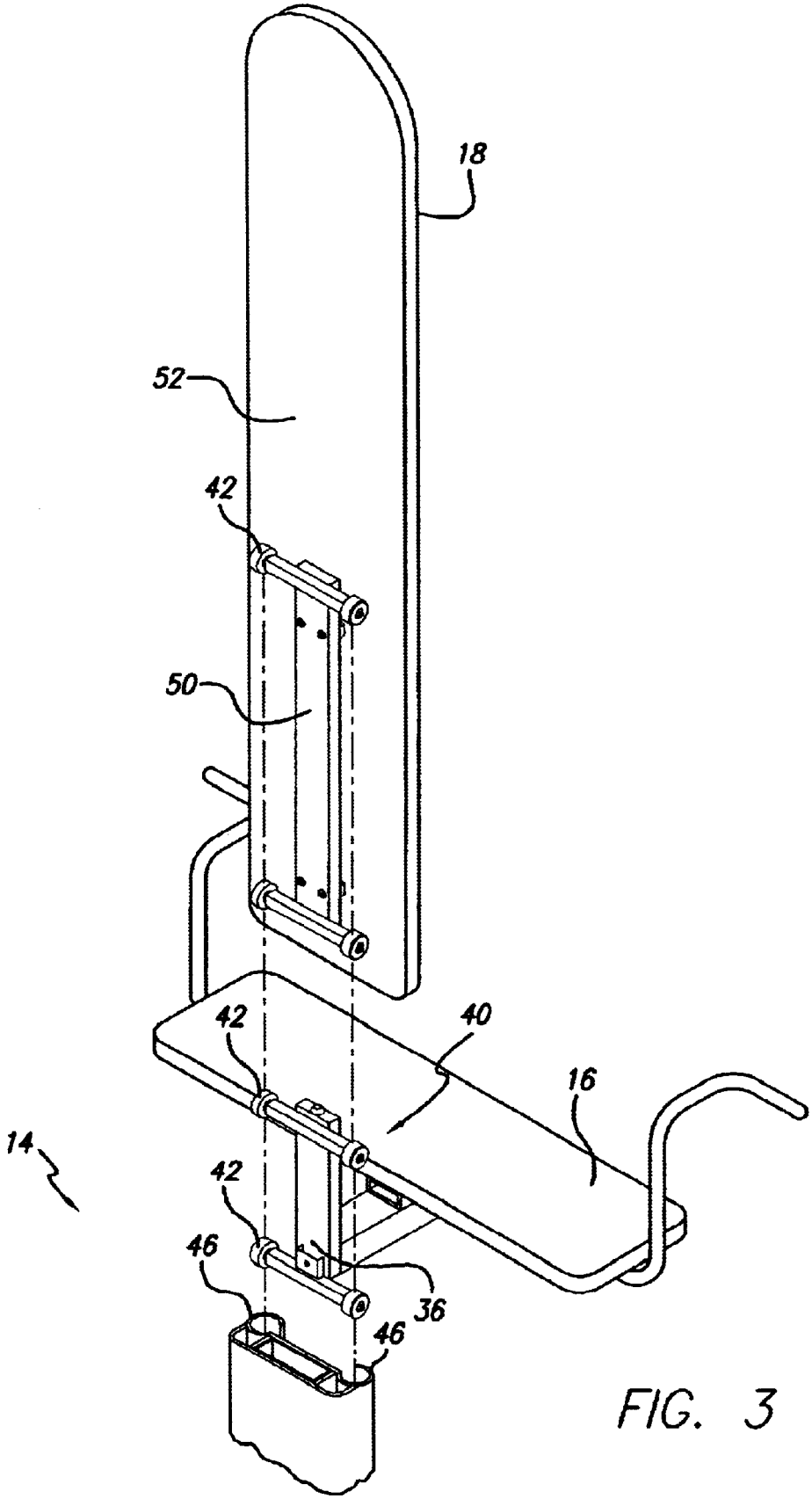
FIG. 3 is an exploded view of a preferred embodiment of the back roller exercise apparatus of the present invention, depicting the adjustable engagement of the seat assembly and the backrest with the support member.

In a preferred embodiment of the present invention, as shown in FIG. 3, the seat 16 includes a roller assembly 40. The roller assembly 40 includes at least two rollers 42, and more preferably four rollers 42, for slidable engagement with the support member 14. The rollers 42 are preferably positioned such that each pair of rollers are in a spaced apart mirror relationship to each other.

The support member 14 includes a roller track 44 dimensioned to receive the rollers 42. Each side 46 of the roller track 44 is dimensioned to closely encompass the rollers 42, allowing the rollers 42 sufficient room to slide up and down freely within the roller track 44 but sufficiently constraining the rollers 42 so that the rollers 42 do not wobble in the roller track 44. The rollers 42 are preferably made of a durable material that will endure the wear of frequently recurrent motion. Additionally, it is preferable to manufacture the rollers from a material that does not create excessive noise when rolling. In a preferred embodiment, the rollers 42 are comprised of plastic and the support member 14 is comprised of metal.

Figure 4:
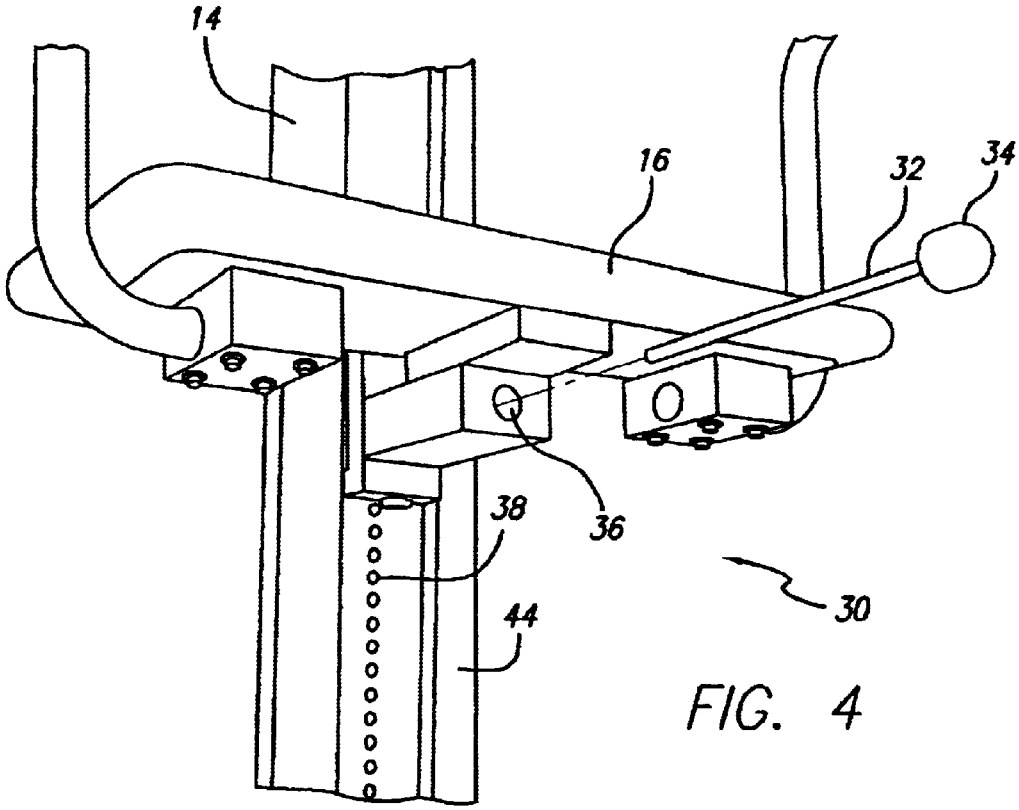
FIG. 4 is a perspective view of a preferred embodiment of the back roller exercise apparatus of the present invention depicting the seat adjustment mechanism.

In a preferred embodiment, as best shown in FIG. 4, the seat 16 includes an adjustment assembly 30. The adjustment assembly 30 includes a seat adjustment pin 32 and an alignment bore 36 dimensioned to receive the seat adjustment pin 32. The seat adjustment pin 32 is preferably spring loaded in a manner known by those skilled in the art and captured to seat 16. The seat adjustment pin 32 includes a bulbous head 34 to facilitate the insertion and extraction of the seat adjustment pin. The support member 14 includes a pattern of receiving bores 38, each bore 38 dimensioned to correspond to the alignment bore 36 and to receive the seat adjustment pin 32. To adjust the height, h, of seat 16 on the support member 14, the seat 16 is moved up or down until the alignment bore 36 aligns with a desired receiving bore 38 on the support member 14. When the bores 36, 38 are aligned, the seat adjustment pin 32 is inserted, locking the seat into the desired position. For a shorter person, the seat 16 would be moved down; and for a taller person, the seat 16 would be moved up to ensure a proper angle at the knee.

The proper height of the seat 16 on the support member 14 depends on the height of the user, the level of exercising expertise, and the range of the user's leg motion. As a general guideline, with respect to knee safety it is desirable to adjust the seat to a position that allows the user to form a 90 degree angle at the user's knee. That is, when seated on the seat 16, the lower leg is perpendicular to the floor and the upper leg is parallel to the floor, and the upper leg and lower leg form a 90 degree angle at the knee, as shown in FIG. 2A. If the seat 16 is in a position wherein the angle formed at the knee is less than 90 degrees, relatively high forces are generated in the knee joint and it is possible that the user will be injured in the course of exercising. Therefore, it is recommended, in the interest of safety, to maintain a knee angle of 90 degrees or greater. Well conditioned, expert users of the exercise apparatus may violate this recommendation with the understanding that they are exercising in a range of motion that is most demanding to the knee joint and exposes the joint to the greatest risk of injury.

Generally, lowering the seat will make the exercise more demanding and difficult. First, by lowering the seat, the range of motion is increased. Second, lowering the seat lowers the biomechanical advantage of the involved user's limbs. Given the increased level of difficulty, advanced users may wish to set the seat at a relatively low position. However, for beginners who are not accustomed to regular exercise, the seat can be raised higher such that the angle formed at the knee is greater than 90 degrees. As described further below, raising seat 16 for a particular user makes it easier to perform the exercises.

Figure 5:
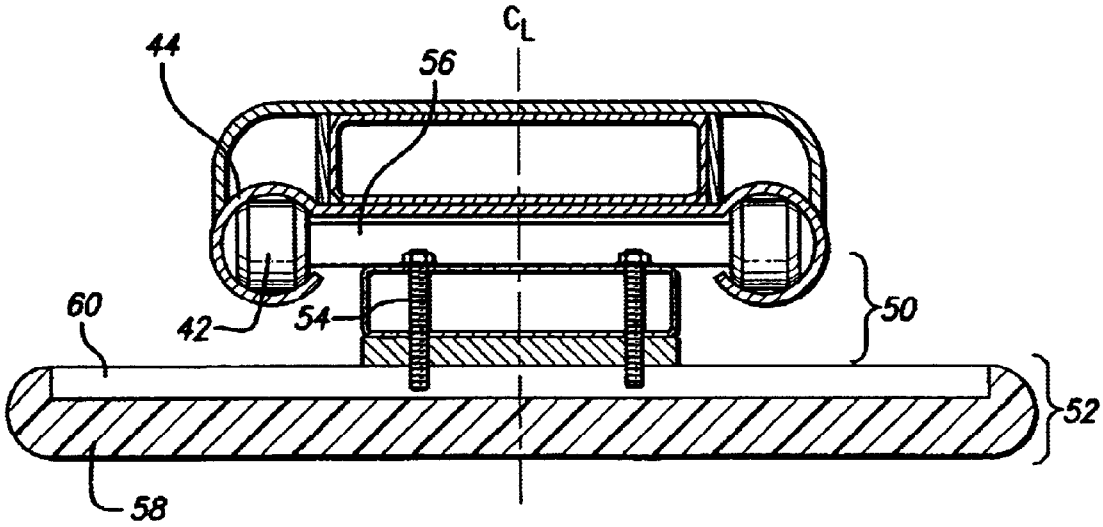
FIG. 5 is top plan view of a preferred embodiment of the back roller exercise apparatus of the present invention, depicting the slidable engagement of the backrest with the support member.

With reference to FIGS. 3 and 5, the backrest 18 slidably engages with support member 14. In a preferred embodiment, the backrest 18 includes a backrest roller assembly 50 and a cushion assembly 52. As best shown in FIG. 5, the cushion assembly 52 is attached to the backrest roller assembly 50 by a fastener 54. The roller assembly 50 preferably includes at least two rollers 42, and more preferably four rollers 42, for slidable engagement with the roller track 44 of the support member 14. The rollers 42 are preferably carried by axles 56 and are positioned such that each pair of rollers are in a spaced apart mirror relationship on the axles 56. The rollers 42 and the roller track 44 are dimensioned to allow the rollers 42 to fit securely within the roller track 44 and easily slide up and down in the roller track 44. Yet the rollers 42 are sufficiently constrained so that the rollers 42 are captured on the axles 56 by the roller track and do not wobble in the roller track 44.

Each roller 42 is designed to carry both radial and thrust loads during operation of the exercise apparatus. The rollers 42 preferably self-center about the center line $C_L$ in the roller track 44. Because the rollers are carried by the roller assembly 50, when the rollers are centered, the roller assembly 50 also self-centers about the center line $C_L$. The axles 56 are attached to the roller assembly 50 by any known means, and more preferably, the axles 56 are welded to the roller assembly 50.

The cushion assembly 52 preferably includes a cushion 58 and a cushion support 60. The cushion support 60 provides structural integrity for the cushion 58 and is preferably constructed from a material that endures the force of the exercise equipment user against the backrest 18. The cushion 58 is preferably constructed from a soft padding that provides comfort to the back of the exercise equipment user when the user's back is pressing against the backrest. In a preferred embodiment the cushion 58 is made of injection molded urethane foam and the cushion support is made of wood.

During the operation of the exercise apparatus, the backrest 18 slides up and down on roller track 44. The limits of motion of the backrest are preferably defined by a lower backrest stop and an upper backrest stop. The lower backrest stop provides user safety by conveniently and reliably setting the user's desired range of motion. In the embodiment depicted in FIGS. 1, 2A and 2B, the seat 16 serves as the lower backrest stop and the track cap 98 serves as the upper backrest stop. The up and down motion of the backrest 18 is limited to the area between the seat 16 and the track cap 98. In the preferred embodiment of the invention, the upper backrest stop is above the user's normal range of motion.

Accordingly, the upper backrest stop does not limit the backrest motion in the normal operation of the apparatus. Rather, the upper backrest stop ensures that the seat 16 and backrest 18 remain captured on the roller track 44.

In alternative embodiments of the invention, the lower backrest stop could include a pin 32 that is adjustably engaged with a receiving bore 38 in the roller track 44. In yet another alternative embodiment of the invention, the backrest 18 is not limited by a lower backrest stop or an upper backrest stop.

Figure 6:
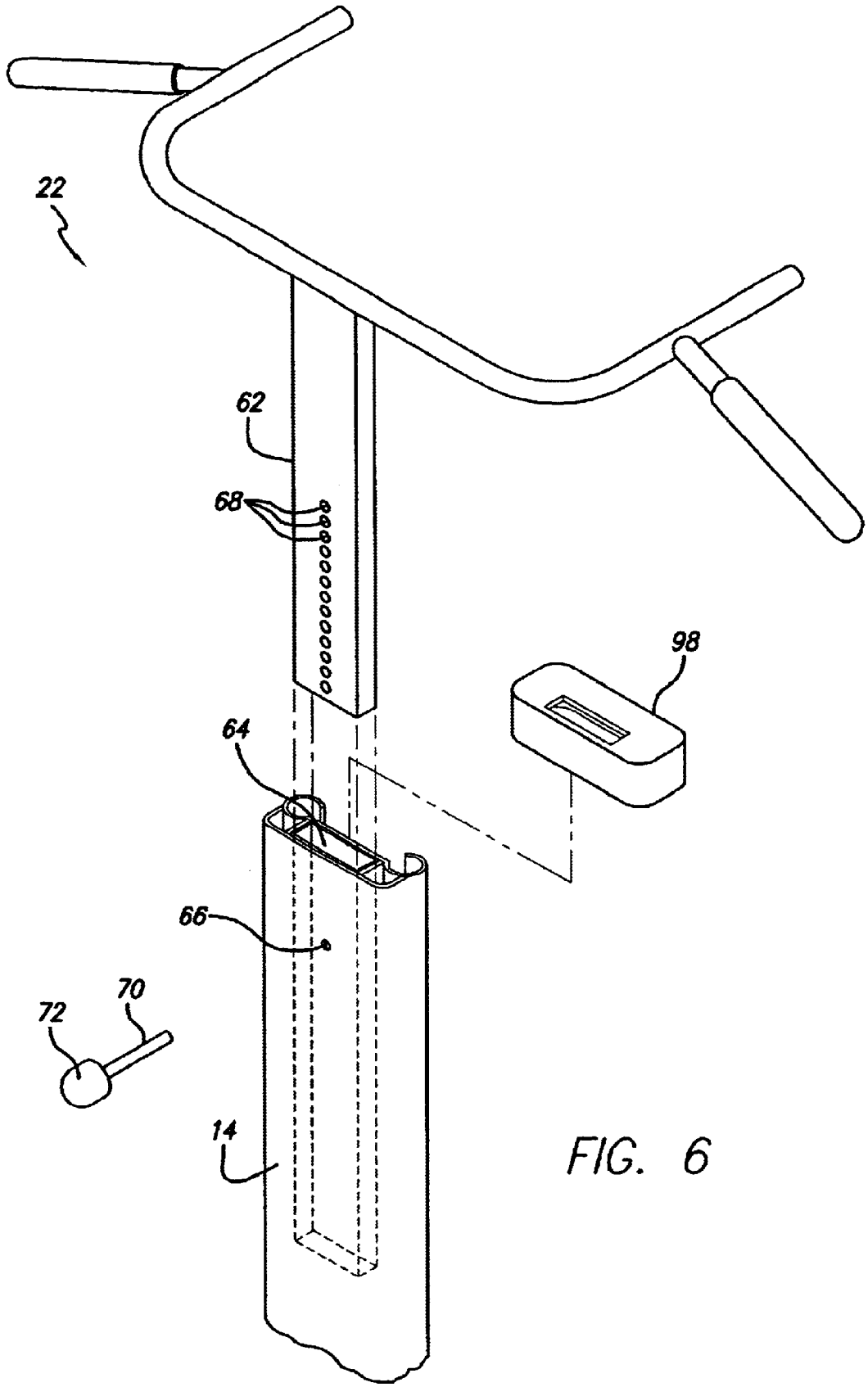
FIG. 6 is a rear perspective view of a preferred embodiment of the back roller exercise apparatus of the present invention, depicting the manner in which the adjustable upper arm is attached onto the support member.

As best shown in FIG. 6, in a preferred embodiment of the present invention, the upper bar 22 is adjustably attached to the support member 14. The upper bar 22 preferably includes an adjustment extension 62 that is dimensioned to slidably engage a channel 64 of the support member 14. The extension 62 is slid down into the channel 64 until a desired height is reached. The support member 14 defines an alignment bore 66 therein and the extension 62 defines a plurality of adjustment bores 68. To attach the upper bar 22 to the support member 14, the alignment bore 66 is aligned with an adjustment bore 68 and secured together by an upper bar adjustment pin 70. The upper bar adjustment pin 70 is preferably spring loaded in a manner known to those skilled in the art and captured to support member 14. Additionally, the adjustment pin 70, preferably has a bulbous head 72 to facilitate insertion and extraction of the pin 70.

To adjust the height of the upper bar 22, adjustment pin 70 is, at least partially, extracted from the support member 14 and the adjustment extension 62 is moved either higher or lower in the channel 64. Upon reaching the desired height, the alignment bore 66 is aligned with the nearest adjustment bore 68, and the adjustment pin 70 is re-inserted into the support member 14 and through the alignment bore 66 and the adjustment bore 68. For a taller person, the adjustment extension 62 is preferably moved higher in the channel 64 and for a shorter person, the adjustment extension will be moved lower in the channel 64.

In a preferred method of using the back roller exercise apparatus 10, the apparatus is readily employed to perform three distinct modes of exercise, namely, strength, aerobic and circuit training. Specifically, the user will be able to do a lunge, a squat, a wide pull-up, a narrow pull-up, a dip and a push-up. These exercises are commonly considered to be among the best exercises for a total toning of the body and can be difficult to perform safely using traditional exercise devices. Initially, the user will make two adjustments to customize the exercise apparatus to the user's dimensions and fitness ability. First, the seat 16 should be adjusted so that when the user is seated, the user's upper leg and lower leg meet at the knee at a 90 degree angle. As discussed above, the 90 degree angle is used as a general guideline and can be varied depending on the fitness level of the user. Second, the upper bar 22 is adjusted so that the user's hands can just reach the widest part of the upper bar 22 from the seated position. Upon completion of the two adjustments, the user can proceed with performing the six exercises. No additional adjustments will be needed in between sets or in between exercises. The lack of interruption allows the user to perform the exercises in a "circuit-style" fashion, minimizing the transition time from exercise to exercise. By performing the exercises continuously, in a circuit fashion, the user is able to simultaneously achieve the benefits of strength and aerobic conditioning.

To safely perform a squat, the user preferably places both of his feet on the base 12, pushes his back against the backrest 18 and, using his legs, slides the backrest 18 up and down on the roller track 44. To facilitate the maintenance of good form during the exercise, the user preferably grips the side handles 24 of the upper bar 22 while performing the lunges. Optimally, an experienced exerciser will use 100% of his body weight as the resistance for the squat. As the user lifts from a sitting position to a modified standing position, the user's legs carry the user's body weight, exercising and strengthening the quadriceps, hamstrings and gluteus muscles. An experienced exerciser will be able to slide the backrest up and down over a large distance, thus maximizing his range of motion for this exercise. The difficulty level of the exercise can be increased by adjusting the position of the feet forward and exerting more force on the backrest, which causes the user to exert more force to the engaged muscles to lift his body weight.

When a squat exercise is performed in a gym on an existing machine, the user usually is required to lay on his back and weight stacks and cables are used to provide resistance for the squat. The exercise apparatus 10 eliminates the need for bulky weight stacks and complex cables, and uses the exerciser's own body weight as resistance for the exercises.

If the user feels tired, weak, or dizzy, the user can simply slide down with the backrest 18 and sit on the seat 16. By facilitating the seating of the user, the exercise apparatus 10 significantly reduces the risk of the user falling as a result of dizziness or loss of balance caused by overexertion during the course of exercising. The seat 16 acts as a lower stop for the backrest 18. Upon arriving at the seat 16, the backrest 18 is stopped. While performing a squat, if the user bends his knee such that the upper leg and lower leg meet at a less than 90 degree angle, the user's knee is in a relatively unsafe configuration. The seat 16 prevents the backrest 18 from proceeding below the seat and thus, prevents the user from bending his knee to form an angle less than 90 degrees.

For many people, the squat is one of the hardest exercises because, to make it effective, the user must actually get down to a position wherein the user's knees are substantially at a 90 degree angle. For novice exercisers, once that position is reached, it is difficult to rise from it. For such a novice exerciser, who is not able to fully support his body weight while doing a squat, the exercise apparatus 10 provides assistance in doing the exercise. First, the seat 16 is raised to decrease the range of motion of the backrest 18. Since the seat serves as a lower stop for the backrest, by raising the seat, the range of travel of the backrest is shortened. By shortening the range of travel of the backrest, the distance for which the user is required to lift his body weight, is decreased. Furthermore, as the seat is adjusted higher, the minimum knee angle increases. This increases the worst case mechanical advantage in the knee joint. Therefore, exercise forces on the knee and involved musculature are reduced, thereby reducing the exercise difficulty. Also, if the user's body weight provides too much resistance for the lower body, the user can utilize his upper body to assist him in performing the exercise. Specifically, the user can grip the side handles 24 of the upper bar 22 and transfer some of the body weight to be pulled up by the arms. The more weight that is supported by the upper body, the less weight that the user will have to lift using his lower body. Accordingly, the user is able to decide the amount of body weight that will be lifted using the arms (also known as a pull up) and the amount of body weight that will be lifted using the legs. For each upper body exercise, the user can decide whether 100% of his body weight will be pulled up by his arms or if some of the weight will be shifted to his legs.

The exercise apparatus of the present invention eliminates the need to workout with a partner, or use a spotter, because there is no risk of being overwhelmed and injured by weight stacks. If the resistance proves too much for the exerciser, he can simply shift the weight to another part of the body. That is, when performing any of the upper body exercises (except the push-up), the legs can be engaged at will to spot for the upper body. Similarly, when performing the leg exercises, the upper body can be engaged at will, using any of the bars, to spot for the lower body. Effectively, the user becomes his own spotter.

In a squat, the user's body weight is lifted primarily using the lower body. In contrast, in a pull-up, the user's body weight is lifted primarily using the upper body. Typically, a pull-up is difficult for a heavier person because a heavy person is not able to lift his entire body weight with his arms. In contrast, the heavy person usually has strong legs because he is accustomed to carrying his weight on his legs. By using the exercise apparatus 10, the heavy person can perform a pull-up with the assistance of lower body muscles. The user can decide the proportion of weight that will be lifted using the arms and the amount of weight that will be lifted by the legs. As the user improves, a higher proportion of weight is shifted from the legs to the arms, providing additional resistance for the pull-up and further strengthening the back and arm muscles.

In a preferred embodiment of the invention, the upper bar 22 includes two side handles 24 and two front handles 26. The side handles 24 are referred to as the wide pull-up bars. Performing a pull-up on the wide pull-up bars exercises and strengthens primarily the back muscles and secondarily the biceps muscles. The front handles 26 are referred to as the narrow pull-up bars. Performing a pull-up on the narrow pull-up bars exercises and strengthens primarily the biceps muscles and secondarily the back muscles. Again, the user is able to distribute his body weight between his upper body and lower body in a manner that will allow the lower body to assist the user in doing either a wide or a narrow pull-up. FIGS. 2A and 2B depict a user performing a wide pull-up using the exercise apparatus.

To perform a lunge safely, the user extends one leg outward such that the user's body weight is supported on a single leg. The user pushes his back against the backrest 18 and, using the leg on the base, slides the backrest 18 up and down on the roller track 44. If the user gets tired or needs assistance in performing the lunge, the user can grip the handles 29 of the lower bar 28 and use the lower bar 28 to help push himself up. For a variation on this exercise, the user can continuously alternate the leg that will support his weight. This exercise is known as "walking" lunges and in performing typical lunges, only the very fit exerciser is capable of performing walking lunges. However, the exercise apparatus 10 provides sufficient support to enable even novice users to perform walking lunges.

In a traditional lunge, the user places one leg behind him and lunges forward with the other leg. It is easy to cheat in a traditional lunge by shifting one's weight from the lunging leg to the back leg. This type of cheating is not possible on the exercise apparatus 10 because only one leg is on the ground and thus, the weight cannot be shifted to the second leg.

Another exercise that can be performed on the exercise apparatus of the present invention is the dip. The dip is one of the best exercises for the tricep muscles. To perform the dip, the user places both of his legs on the base 14 and grips the handles 29 of the lower bar 28 with his hands. The user's weight is primarily supported by the user's arms. The user then pushes against the backrest 18, and using his arms, slides the backrest 18 up and down on the roller track 44.

When using known dip bars, the user's legs are generally hanging in mid-air and as the user lowers his body toward the dip bars, he risks lowering his body too far and, thus, injuring his shoulder. The dip especially irritates the shoulders of novice exercisers because as the exercisers move to the lowest part of the dip, their weight becomes too heavy to manage for the tricep and shoulder muscles and the users fall lower than the proper position, overloading the shoulder. The exercise apparatus 10 overcomes the disadvantages of known dip exercise devices. The base 14 of the exercise apparatus 10 provides support for the user's feet so that his legs are not hanging in mid-air. Furthermore, if the user attempts to move too far down in the dip, to a position that would cause injury to his shoulder, he would be stopped by the seat 16.

The user can decide the level of difficulty of the dip exercise by using his lower body to assist in supporting part of his body weight. The more weight that is shifted to the lower body, the easier the dip exercises will be for the user. As the user's muscles strengthen, the user can gradually shift additional weight from the lower body to the triceps.

The squat, lunge, wide pull-up, narrow pull-up, and dip exercises can all be performed in an upright position, either sitting or in a modified standing position. The sitting position and the modified standing position are especially helpful for older exercisers who find it difficult to lift themselves off of the ground or from a lying down position. An older exerciser, who has completed one of these exercises, will find himself in a seated position at the end of the exercise. At that point, the exerciser can use the sliding backrest 18 to push himself up to a standing position in a stance that would facilitate the exerciser's exit from the exercise apparatus 10. In an alternative embodiment of the invention, the seat 16 is attached to the backrest 18 and slides up and down simultaneously with the backrest 18. In this embodiment, The user will remain in a seated position while sliding up and down on the track. A lower stop (not shown) is preferably provided to define a lower limit for the motion of the seat 16 with the backrest 18.

Another exercise that can be performed using the exercise apparatus 10 is the push-up. Typically, the push-up is a very difficult exercise because the exerciser has to get down on the ground and, using his arms, push his entire weight off of the ground. Most people are not able lift their entire body weight, and this is especially true for overweight or out of shape exercisers. To perform a push-up using the exercise apparatus 10, the user faces the exercise apparatus 10 and, while gripping the lower bar handles 29, moves his legs away from the exercise apparatus 10. Accordingly, the user will be in a push-up position at a selected inclined angle, also known as the modified push-up position. The inclined angle is more comfortable than being flat on the ground. Additionally, it is easier to perform a push-up at an inclined angle because the exerciser is not required to lift his entire weight off of the ground from a flat position. The lateral projection portions of the lower bar handles 29, provide a comfortable purchase for wrist comfort. Specifically, this handle orientation ensures that the user is able to maintain a comfortable angle of wrist flexure throughout the exercise. This feature is especially important and useful to users with compromised wrist mobility. The position of the seat prevents the exerciser from lowering his body too far down and thus, prevents injuries to the user's shoulders and elbows.

To further facilitate executing a push-up, a novice exerciser can raise the seat 16 higher, further decreasing the load that will be placed on the arms. The higher the seat is raised, the easier it will be to execute the push-up. As the novice exerciser gains experience and strengthens his muscles, the seat can be lowered and brought closer to the ground, increasing the load that will be lifted by the arms.

As discussed above, no adjustments to the exercise apparatus are necessary in between exercises. The user of the exercise apparatus 10 can do the squat, lunge, narrow pull-up, wide pull-up, dip and push-up exercises one after the other, without stopping to adjust any cables, weights or other components. In a preferred embodiment of using the exercise apparatus of the present invention, the user performs 8–12 squats, followed immediately by 8–12 wide pull-ups, followed immediately by 8–12 lunges, followed immediate by 8–12 dips, followed immediately by 8–12 narrow pull-ups, followed immediately by 8–12 push-ups. Preferably, the rotation is repeated four times. This rotation allows the user to exercise the arms and the legs alternately, allowing the leg muscles to rest while the arm muscles are being exercised and vice versa. Accordingly, these six exercises can be performed using a simple, convenient exercise apparatus without any need to adjust weight stacks, change cable connections or determine the amount of weights that should be provided for resistance.

The various exercises can be performed in any order desired by the user, however, the best results are achieved by performing the exercises in a circuit fashion. Circuit fashion is defined herein as performing the exercises in a continuous, non-interrupted fashion. The benefit of performing the exercises in a circuit fashion is that the user is able to exercise aerobically in addition to the strength training exercises. Namely, the heart rate is increased and the body begins to burn more calories. The exercise apparatus 10 allows the user to perform the exercises in a circuit fashion because the transition time between exercises is reduced in that there is no need for a user to adjust weight stacks or cables in between exercises, nor is the user required to go from machine to machine to exercise each muscle individually.

The exercise apparatus 10 is designed to allow people of all sizes, body shapes and fitness levels to perform the six exercises in a safe and effective manner. The adjustable seat 16 and upper bar 22 allows persons of any height to customize the machine to their height. The user is able to distribute his weight and determine how much of his weight will be supported by the upper body and how much will be supported by the lower body without having to make any adjustments to weight stacks. In this regard, the respective muscles in the upper body and lower body will receive the exact amount of weight that each muscle can handle without overexerting the muscle during the workout. As the muscles strengthen, additional weight can be shifted to the strengthened muscle. Accordingly, the machine can be used by and is effective for both a novice and an experienced exerciser.

Figure 7:
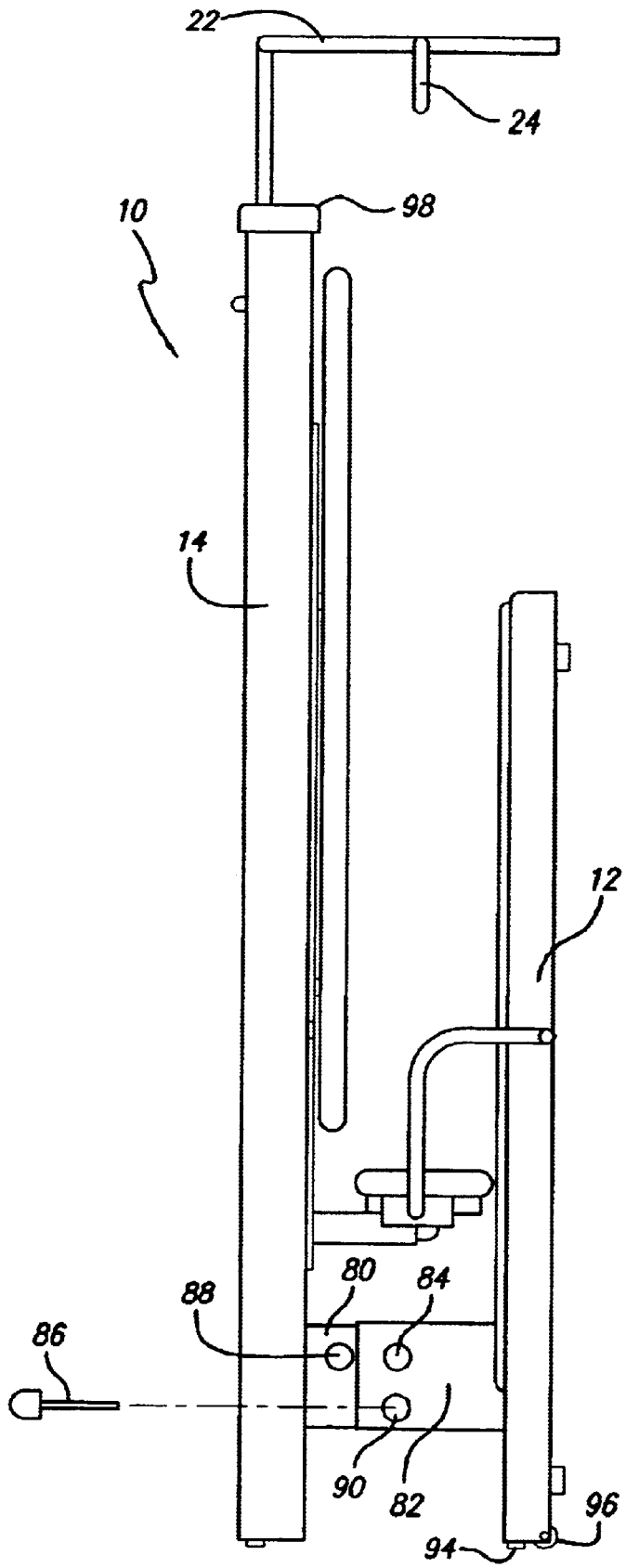
FIG. 7 is a side view of a preferred embodiment of the back roller exercise apparatus of the present invention in a storage configuration.

As best shown in FIG. 7, after the workout is completed, the exercise apparatus 10 can preferably be folded and stowed away. In a preferred embodiment of the present invention, the support member 14 includes a support member connecting arm 80 and the base 12 includes a base connecting arm 82. The connecting arm 80 of the support member 14 is pivotally attached to the connecting arm 82 of the base 12 at pivot point 84. In the operating configuration, the base 12 lies on a flat surface and the support member 14 extends upwardly therefrom in a substantially vertical manner. In a storage configuration, the support member is folded downward, pivoting about pivot point 84 until the support member is substantially horizontal, in a parallel relationship to the base 12.

A latch pin 86, captured to base connecting arm 82, is provided to lock the exercise apparatus 10 in either an operating configuration or a storage configuration. To lock the exercise apparatus 10 in an operating configuration, the support member 14 is opened until it is in a vertical position. In the operating configuration, a first channel 88 on the support member connecting arm 80 aligns with a locking channel 90 on the base connecting arm 82, and the exercise apparatus 10 is locked in an operating configuration by inserting the latch pin through the locking channel 90 and the first channel 88. To lock the exercise apparatus 10 in a storage configuration, the support member 14 is folded until it is in a horizontal position, parallel to base 12. In the storage configuration, a second channel 92 (shown in FIG. 2A) on the support member connecting arm 80 aligns with a locking channel 90 on the base connecting arm 82, and the exercise apparatus 10 is locked in a storage configuration by inserting the latch pin 86 through the locking channel 90 and the second channel 92.

An exercise apparatus 10 which has been locked in the storage configuration, can be lifted to an upright position, as shown in FIG. 7. A plurality of feet 94 are provided to protect the floor from being scratched or damaged by the exercise apparatus. From this position, the exercise apparatus 10 can be moved by tilting the exercise apparatus such that the its weight is supported on wheels 96. Once the exercise apparatus is tilted, it can be moved by simply rolling it to the desired location.

To facilitate the tilting of the exercise apparatus toward the wheel 96, in one embodiment of the invention, a handle (not shown) is provided on the support member 14. To tilt the exercise apparatus, a user can grab the handle and pull the handle toward the base 12. The handle can be integral to the track cap 98. In another embodiment of the invention, as shown in FIG. 7, the upper bar 22 can be used to tilt the exercise apparatus 10. The user can grab the upper bar 22 at its side handles 24, and pull the upper bar 22 toward the base 12, thus tilting the exercise apparatus. The upper bar 22 can also be used as a handle to roll the exercise apparatus to the desired location.

What is claimed is:

1. An exercise apparatus comprising:

a base;

a vertical support member attached to the base;

a backrest slidably engaged with the support member;

a seat adjustably attached to the support member; and an upper bar horizontally disposed and adjustably attached to the support member, wherein the upper bar comprises two side handles and two front handles.

2. An exercise apparatus in accordance with claim 1 wherein the support member comprises a roller track, the backrest comprises at least one pair of rollers, and wherein the rollers of the backrest slidably engage the roller track of the support member.

3. An exercise apparatus in accordance with claim 2 wherein the seat slidably engages the roller track of the support member.

4. An exercise apparatus in accordance with claim 3 further comprising a seat adjustment pin, wherein the seat comprises an alignment bore dimensioned to receive the seat adjustment pin, and wherein the support member comprises a plurality of height adjustment bores dimensioned to receive the seat adjustment pin, wherein the seat is adjustably attached to the support member by aligning the alignment bore with one of the plurality of height adjustment bores and inserting the seat adjustment pin through the alignment bore and the height adjustment bore.

5. An exercise apparatus in accordance with claim 1 further comprising a lower bar attached to the seat.

6. An exercise apparatus in accordance with claim 1 wherein the support member comprises a support member connection member, the base comprises a base connection member and wherein the base connection member is pivotally attached to the support member connection member.

7. An exercise apparatus in accordance with claim 6 comprising an operating configuration and a storage configuration, wherein in the operating configuration, the support member is in a substantially vertical position and wherein in the storage configuration, the support member is substantially parallel to the base.

8. An exercise apparatus comprising:

a base;

a vertical support member attached to the base;

a backrest slidably engaged with the support member;

a seat adjustably attached to the support member;

an upper bar horizontally disposed and adjustably attached to the support member; and an upper bar adjustment pin, wherein the upper bar comprises a connection member having a plurality of adjustment bores dimensioned to receive the upper bar adjustment pin, wherein the support member comprises an alignment bore dimensioned to receive the upper bar adjustment pin, and wherein the upper bar is adjustably attached to the support member by aligning one of the plurality of adjustment bores with the alignment bore and inserting the upper bar adjustment pin through the adjustment bore and the alignment bore.

9. An exercise apparatus in accordance with claim 8 wherein the support member comprises a roller track, the backrest comprises at least one pair of rollers, and wherein the rollers of the backrest slidably engage the roller track of the support member.

10. An exercise apparatus in accordance with claim 9 wherein the seat slidably engages the roller track of the support member.

11. An exercise apparatus in accordance with claim 10 further comprising a seat adjustment pin, wherein the seat comprises an alignment bore dimensioned to receive the seat adjustment pin, and wherein the support member comprises a plurality of height adjustment bores dimensioned to receive the seat adjustment pin, wherein the seat is adjustably attached to the support member by aligning the alignment bore with one of the plurality of height adjustment bores and inserting the seat adjustment pin through the alignment bore and the height adjustment bore.

12. An exercise apparatus in accordance with claim 8 further comprising a lower bar attached to the seat.

13. An exercise apparatus in accordance with claim 8 wherein the support member comprises a support member connection member, the base comprises a base connection member and wherein the base connection member is pivotally attached to the support member connection member.

14. An exercise apparatus in accordance with claim 13 comprising an operating configuration and a storage configuration, wherein in the operating configuration, the support member is in a substantially vertical position and wherein in the storage configuration, the support member is substantially parallel to the base.

15. An exercise apparatus comprising:

a base;

a vertical support member attached to the base;

a backrest slidably engaged with the support member;

a seat adjustably attached to the support member; and a lower bar attached to the seat, wherein the lower bar comprises a vertical portion extending from the seat and a horizontal portion at a terminal end.

16. An exercise apparatus in accordance with claim 15 wherein the support member comprises a roller track, the backrest comprises at least one pair of rollers, and wherein the rollers of the backrest slidably engage the roller track of the support member.

17. An exercise apparatus in accordance with claim 16 wherein the seat slidably engages the roller track of the support member.

18. An exercise apparatus in accordance with claim 17 further comprising a seat adjustment pin, wherein the seat comprises an alignment bore dimensioned to receive the seat adjustment pin, and wherein the support member comprises a plurality of height adjustment bores dimensioned to receive the seat adjustment pin, wherein the seat is adjustably attached to the support member by aligning the alignment bore with one of the plurality of height adjustment bores and inserting the seat adjustment pin through the alignment bore and the height adjustment bore.

19. An exercise apparatus in accordance with claim 15 wherein the support member comprises a support member connection member, the base comprises a base connection member and wherein the base connection member is pivotally attached to the support member connection member.

20. An exercise apparatus in accordance with claim 19 comprising an operating configuration and a storage configuration, wherein in the operating configuration, the support member is in a substantially vertical position and wherein in the storage configuration, the support member is substantially parallel to the base.

21. A method of exercising the arms and legs of a user using an exercise apparatus having a base, a support member attached to the base, a backrest slidably engaged with the support member, and an upper bar adjustably attached to the support member, the upper bar having a pair of side handles and a pair of front handles, comprising;

pushing the user's back against the backrest and sliding the backrest up and down on the support member; and adjusting the upper bar on the support member to correspond to a user's reach;

wherein the user's weight provides resistance for the movement of the backrest on the support member.

22. A method of exercising in accordance with claim 21, comprising gripping the upper bar and pulling up to perform a pull up.

23. A method of exercising in accordance with claim 22 wherein the user's weight provides the resistance for the pull up.

24. A method of exercising in accordance with claim 23 wherein a portion of the user's weight is supported by the user's legs to facilitate the performance of a pull up.

25. A method of exercising in accordance with claim 23 wherein the user grips the side handles of the upper bar to perform a wide pull up.

26. A method of exercising in accordance with claim 23 wherein the user grips the front handles of the upper bar to perform a narrow pull up.

27. A method of exercising the arms and legs of a user using an exercise apparatus having a base, a support member attached to the base, a backrest slidably engaged with the support member, a seat adjustably attached to the support member, and a lower bar attached to the seat; comprising:

pushing the user's back against the backrest and sliding the backrest up and down on the support member;

adjusting the seat on the support member to correspond to a user's height;

gripping the lower bar;

pushing the user's back against the backrest; and using the user's arms, sliding the backrest up and down on the support member performing a dip;

wherein the user's weight provides resistance for the movement of the backrest on the support member.

28. A method of exercising in accordance with claim 27 wherein a portion of a user's weight is supported by the user's legs to facilitate the performance of a dip.

29. An exercise apparatus supportable by a wall, comprising:

a support member adapted to be attached to the wall;

a backrest slidably engaged with the support member;

an attachment system adapted to attach the support member to the wall;

a seat adjustably attached to the support member; and an upper bar horizontally disposed and adjustably attached to the support member.

30. An exercise apparatus supportable by a wall, comprising:

a support member adapted to be attached to the wall;

a backrest slidably engaged with the support member;

an attachment system adapted to attach the support member to the wall;

a seat adjustably attached to the support member; and a lower bar attached to the seat.

* * * * *